US010476206B2

(12) United States Patent
Noro et al.

(10) Patent No.: US 10,476,206 B2
(45) Date of Patent: Nov. 12, 2019

(54) CONNECTOR HOUSING ASSEMBLY TO BE MATED EVEN WHEN A-SHORT CANCELLING PROJECTION IS DEFORMED

(71) Applicant: Sumitomo Wiring Systems, Ltd., Yokkaichi, Mie (JP)

(72) Inventors: Yutaka Noro, Mie (JP); Masahito Matsuura, Mie (JP); Takahiro Kikuchi, Mie (JP); Toshihiro Ito, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/063,482

(22) PCT Filed: Dec. 22, 2016

(86) PCT No.: PCT/JP2016/088307
§ 371 (c)(1),
(2) Date: Jun. 18, 2018

(87) PCT Pub. No.: WO2017/110983
PCT Pub. Date: Jun. 29, 2017

(65) Prior Publication Data

US 2018/0375259 A1 Dec. 27, 2018

(30) Foreign Application Priority Data

Dec. 22, 2015 (JP) ..... 2015-249342

(51) Int. Cl.
*H01R 13/64* (2006.01)
*H01R 13/703* (2006.01)
(Continued)

(52) U.S. Cl.
CPC ..... *H01R 13/64* (2013.01); *H01R 13/7032* (2013.01); *H01R 13/71* (2013.01);
(Continued)

(58) Field of Classification Search
CPC ..... H01R 13/64; H01R 13/71; H01R 13/641; H01R 13/703; H01R 13/7031; H01R 13/7033; H01R 13/7036
(Continued)

(56) References Cited

U.S. PATENT DOCUMENTS 5,788,520 A * 8/1998 Roche ..... H01R 13/7032 200/51.1
5,803,756 A * 9/1998 Furutani ..... H01R 13/7032 200/51.1
(Continued)

FOREIGN PATENT DOCUMENTS

JP 9-50859 2/1997
JP 11-176522 7/1999
(Continued)

OTHER PUBLICATIONS

International Search Report dated Mar. 28, 2017.
European Search Report dated Nov. 7, 2018.

*Primary Examiner* — Travis S Chambers
(74) *Attorney, Agent, or Firm* — Gerald E. Hespos; Michael J. Porco; Matthew T. Hespos

(57) ABSTRACT

A short-canceling projection (35) has a support (36) and two plate-shaped insulating parts (37). With housings (10, 30) mated, the support (36) partitions two elastic contact pieces (24) of a short terminal (22). Plate-shaped insulating portions (37) protrude in opposite directions relative to the support (36), and, with the housings (10, 30) mated, enter between two female terminal fittings (12) and the elastic contact pieces (24) and cancel shorting between the female terminal fittings (12). Correction parts (41, 42, 43) are formed on the support (36) and the plate-shaped insulating portions (37) and make contact with the first housing (10) to
(Continued)

displace the short-canceling projection (35) in the direction of approaching the short terminal (22).

7 Claims, 12 Drawing Sheets

(51) Int. Cl.
*H01R 13/71* (2006.01)
*H01R 13/436* (2006.01)
*H01R 107/00* (2006.01)

(52) U.S. Cl.
CPC ..... *H01R 13/4361* (2013.01); *H01R 2107/00* (2013.01); *H01R 2201/26* (2013.01)

(58) Field of Classification Search
USPC ..... 439/188, 489
See application file for complete search history.

(56) References Cited

U.S. PATENT DOCUMENTS

| | | | | |
|---|---|---|---|---|
| 6,045,395 | A * | 4/2000 | Saito | H01R 13/641 439/354 |
| 6,171,124 | B1 * | 1/2001 | Kojima | H01R 13/7032 200/51.1 |
| 7,488,197 | B2 * | 2/2009 | Shinozaki | H01R 13/7031 439/489 |
| 7,955,104 | B1 * | 6/2011 | Wicks | H01R 13/7032 439/188 |
| 8,657,621 | B2 * | 2/2014 | Fujiwara | H01R 13/641 439/188 |
| 2008/0020630 | A1 * | 1/2008 | Shinozaki | H01R 13/7031 439/489 |
| 2008/0220639 | A1 | 9/2008 | Ohara | |
| 2008/0261425 | A1 | 10/2008 | Nakamura | |

FOREIGN PATENT DOCUMENTS

| | | | |
|---|---|---|---|
| JP | 2002260790 | A | 9/2002 |
| JP | 2008097908 | A | 4/2008 |
| JP | 2008-293938 | | 12/2008 |

* cited by examiner

CONNECTOR HOUSING ASSEMBLY TO BE MATED EVEN WHEN A-SHORT CANCELLING PROJECTION IS DEFORMED

BACKGROUND

Field of the Invention

The invention relates to a connector.

Description of the Related Art

Japanese Unexamined Patent Application Publication No. H11-176522 discloses a connector that includes a female housing attached with a short terminal and two female terminal fittings, and a male housing including a short-cancelling projection. When the housings are separated, the short terminal keeps the female terminal fittings in a short-circuiting state. When the housings are mated, the short-cancelling projection is placed between the short terminal and the female terminal fittings to cancel the short-circuiting of the female terminal fittings.

In a state where the short-circuiting of the female terminal fittings is cancelled by the short-cancelling projection, an elastic contact piece of the short terminal always presses the short-cancelling projection toward the female terminal fitting. Thus, the short-cancelling projection may be deform toward the female terminal fitting due to a creep phenomenon when the housings are separated for maintenance or the like. The deformed short-cancelling projection then could abut against the front face of the female housings during a subsequent mating attempt to prevent the housings from being mated smoothly.

The invention has been made in view of the situation described above. It is an objective of the invention to allow the housings to be mated smoothly even when the short-cancelling projection is deformed.

SUMMARY

The invention relates to a connector that includes a first housing with two laterally arranged terminal fittings and a second housing that can be mated with and separated from the first housing. A short terminal is provided in the first housing and has elastic contact pieces that elastically contact and short circuit the terminal fittings when the first housing is being separated from the second housing. A short-cancelling projection is formed in the second housing and protrudes in the same direction as a direction in which the second housing is mated with the first housing. The short-cancelling projection has a support configured to partition the elastic contact pieces when the first housing is being mated with the second housing. The short-cancelling projection further includes two plate-shaped insulating portions protruding from the support in opposite directions from each other. The plate-shaped insulating portions are configured to be placed between the elastic contact pieces and the terminal fittings to cancel the short circuiting of the terminal fittings when the first housing is mated with the second housing. A correction portion is formed on at least one of a protruding end of the support and a protruding end of the plate-shaped insulating portion. The correction portion is configured to abut the first housing and to displace the short-cancelling projection in a direction along which the short-cancelling projection approaches the short terminal.

When the housings are tried to be re-mated in a state where the depression force from the elastic contact piece causes the short-cancelling projection to deform abnormally in a direction away from the short terminal. However, the correction portion is abutted to the first housing and displaces the short-cancelling projection toward the short terminal. This prevents the short-cancelling projection from being abutted to the first housing and provides smooth mating of the housings.

The protruding end of the support may have a first correction portion inclined to approach the short terminal while extending toward a tip end in a protruding direction of the short-cancelling projection. The support is provided to partition two elastic contact pieces. Thus, the support can have a large size in the direction along which the elastic contact piece depresses the terminal fitting. This consequently can provide a large range within which the correction by the first correction portion can be achieved.

The tip end of the first correction portion may be provided beyond the protruding end of the plate-shaped insulating portion in the protruding direction. This configuration allows the first correction portion to correct the shape of the short-cancelling projection prior to the abutment of the plate-shaped insulating portion to the first housing in a process of mating the housings.

The protruding end of the plate-shaped insulating portion may have a second correction portion inclined backward in the protruding direction of the short-cancelling projection while extending away from the support. The plate-shaped insulating portion is displaced in the plate thickness direction due to the depression by the elastic contact piece. The displacement amount increases in a direction toward the free end away from the support. The second correction portion provided at the protruding end of the plate-shaped insulating portion is inclined backward in the protrusion direction of the short-cancelling projection while extending away from the support. This inclination allows, in a process of mating the housings, the second correction portion to be abutted consecutively to the first housing in an order from a region closer to the support in which the displacement amount is relatively small. This can prevent the plate-shaped insulating portion from being abutted to the first housing, thus allowing the housings to be mated securely.

The protruding end of the plate-shaped insulating portion may have a third correction portion that is inclined to approach the short terminal while extending toward the tip end in the protruding direction of the short-cancelling projection. This configuration allows the third correction portion to correct the short-cancelling projection after the correction of the short-cancelling projection by the first correction portion.

The third correction portion may be smoothly continuous to the first correction portion. According to this configuration, the correction operation by the first correction portion and the correction operation by the third correction portion can be performed without being interrupted for example.

DETAILED DESCRIPTION

The following section will describe the invention with reference to FIG. 1 to FIG. 14. The connector of this embodiment includes a first housing 10 and a second housing 30 that can be mated to each other and can be separated from each other. In the following description, the left side in FIG. 2 and FIGS. 9 to 12 is defined as the front in the front-and-rear direction with regard to the first housing 10. The right side in FIGS. 3 to 6 and FIGS. 9 to 12 is defined as the front in the front-and-rear direction with regard to the second housing 30. Regarding the up-and-down direction, the upper side and the lower side in FIGS. 1 to 5 and FIGS. 7 to 14 are directly defined as the upper direction and the lower direction.

<First Housing 10>

Figure 1:
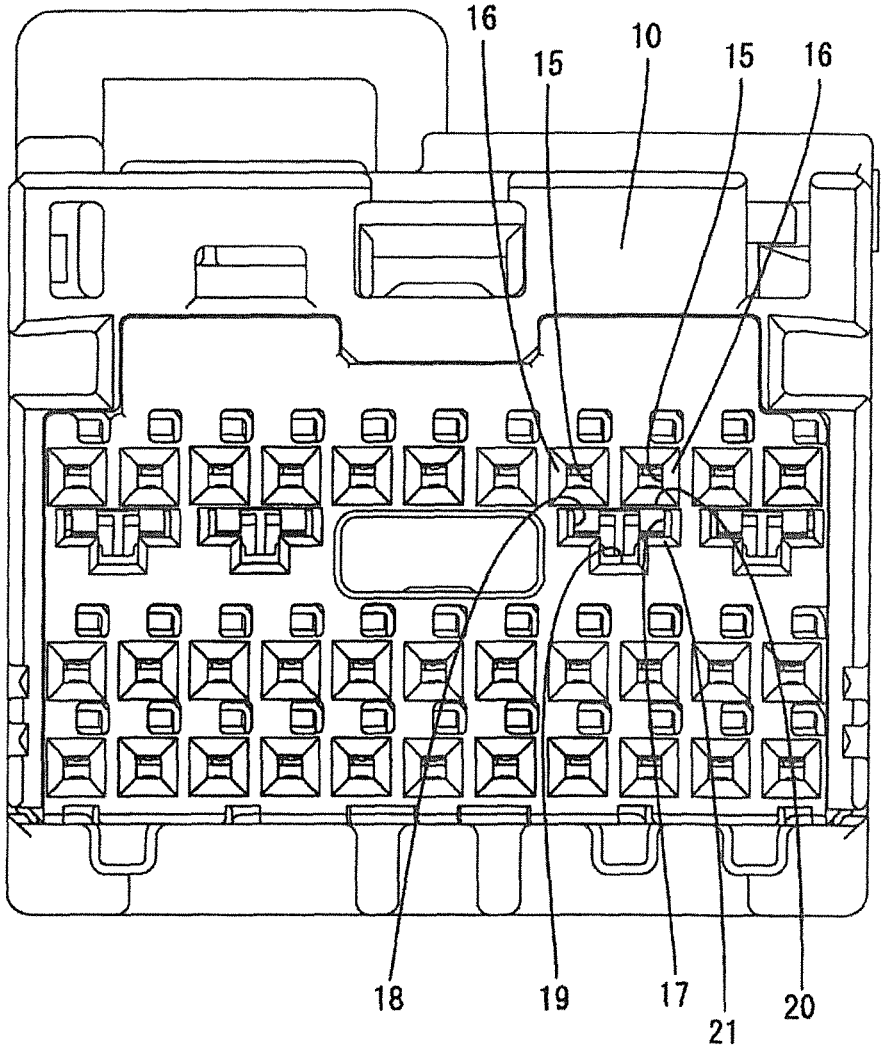
FIG. 1 is a front view illustrating the first housing of Embodiment 1.
Figure 2:
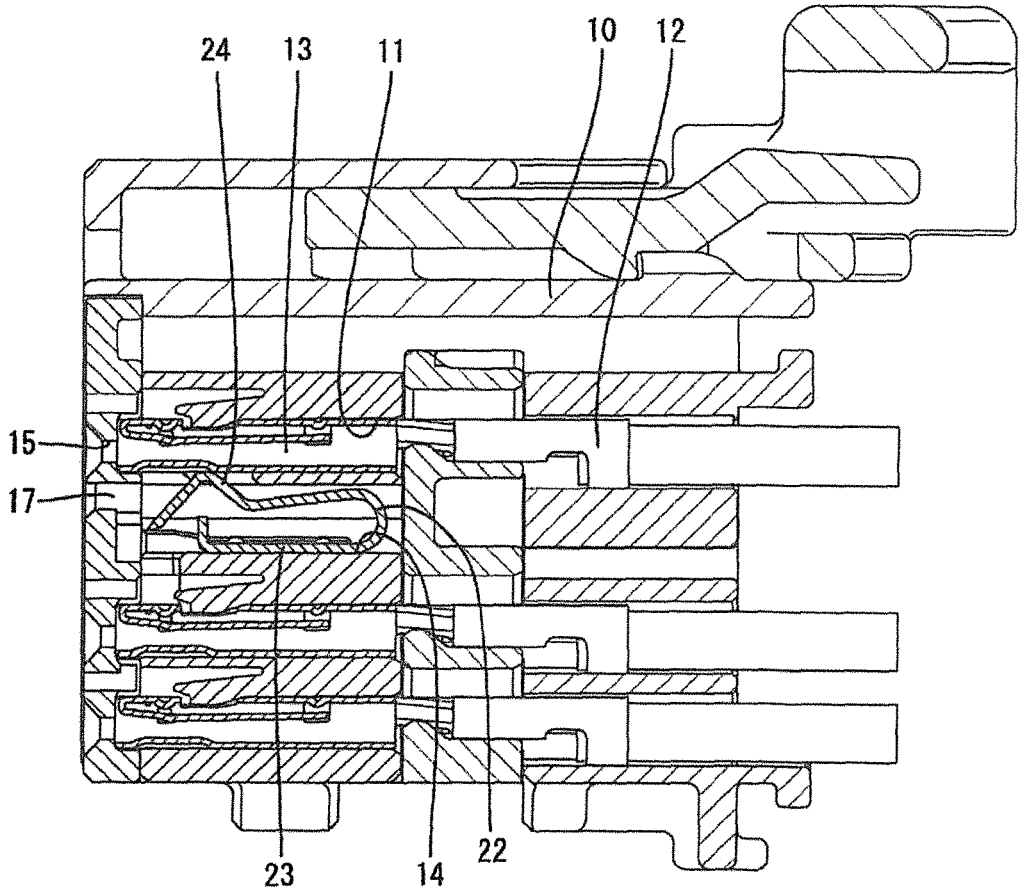
FIG. 2 is a side cross-sectional view of the first housing.
Figure 13:
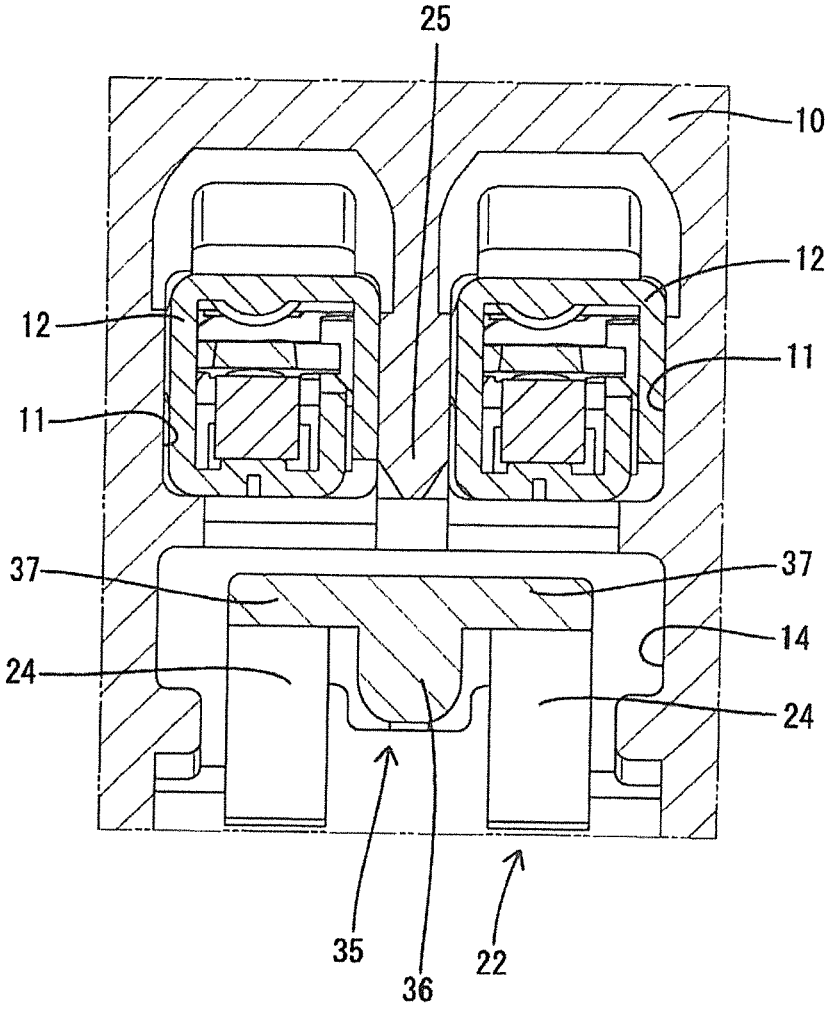
FIG. 13 is a front sectional view illustrating the not-deformed short-cancelling projection abutted to the elastic contact piece.

The first housing 10 is made of synthetic resin and the entirety has a block-like shape as shown in FIGS. 1 and 2. The first housing 10 includes therein a plurality of elongate terminal storage rooms 11 extending in the front-and-rear direction. The terminal storage rooms 11 are arranged in the upper-and-lower direction and the left-and-right direction. A female terminal fitting 12 is inserted into each terminal storage room 11. Each female terminal fitting 12 includes a square tube section 13 at a front end section. The terminal storage rooms 11 adjacent to each other at the uppermost stage in the left-and-right direction define a pair. As shown in FIGS. 1 and 13, one terminal storage space 14 is provided at the lower side of each pair of two terminal storage rooms 11. A pair of terminal storage rooms 11 has the lower face of the front end section communicating with the upper face of the terminal storage space 14.

As shown in FIG. 1, the front face of the first housing 10 has tab insertion openings 15 individually communicating with the front end of each terminal storage room 11. Each tab insertion opening 15 receives a tab 34 of a male terminal fitting 33 provided in the second housing 30 (which will be described later) is inserted into the terminal storage room 11. The tab insertion opening 15 is substantially square. The opening of each tab insertion opening 15 has a guiding inclined plane 16 provided over the entire periphery.

Figure 8:
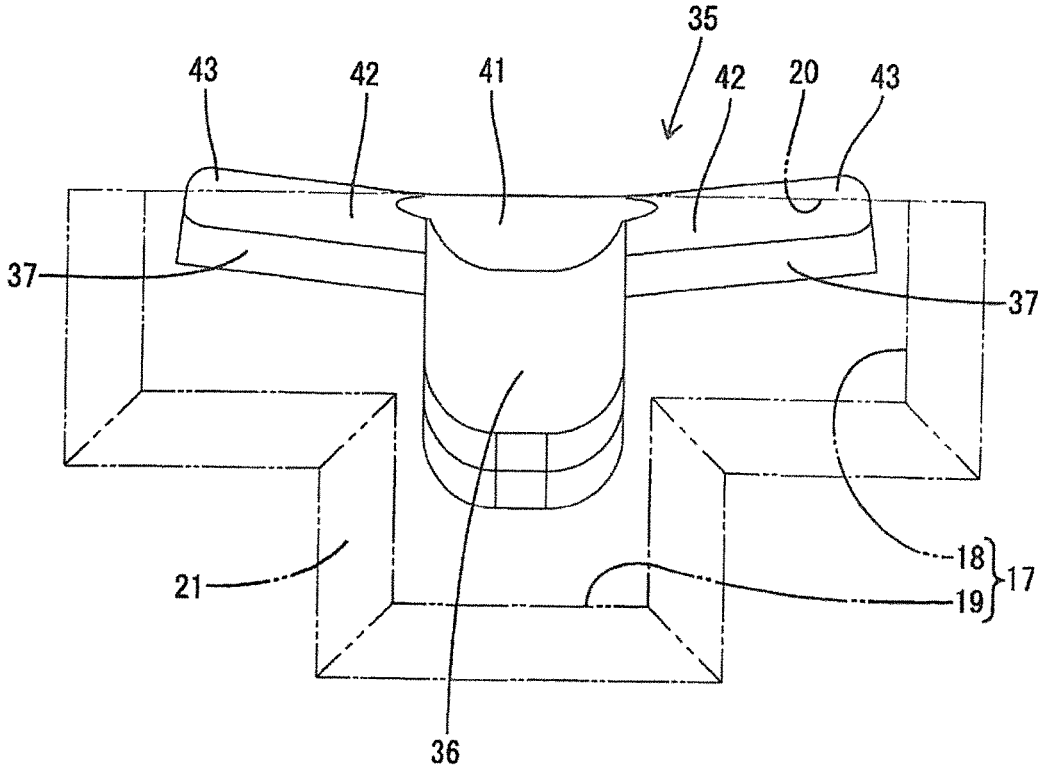
FIG. 8 is a partially-enlarged front view illustrating the short-cancelling projection that is deformed.

The front face of the first housing 10 has a cancellation insertion inlet 17 opened to communicate with the upper end of the terminal storage space 14. As shown in FIGS. 1 and 8, the cancellation insertion inlet 17 is composed of a first opening 18 and a second opening 19. The first opening 18 has a slit-like shape elongating in the left-and-right direction. The first opening 18 is formed in the left-and-right direction within a region corresponding to two of the terminal storage rooms 11 (two tab insertion openings 15) provided at the upper side of the terminal storage space 14. The second opening 19 is provided at the lower side of the first opening 18 and communicates with the center of the first opening 18 in the left-and-right direction.

As shown in FIGS. 1 and 8, a region of the opening edge of the first opening 18, except for the opening upper edge 20, includes a guide face 21 obtained by tapering and concaving the front face of the first housing 10. The opening edge of the second opening 19 also has the guide face 21. On the other hand, since the opening upper edge 20 of the first opening 18 is close to the guiding inclined plane 16 of the tab insertion opening 15, the opening upper edge 20 does not have the guide face 21 on the front of the first housing 10. Thus the front face of the first housing 10 has a substantially right angle to the inner face of the first opening 18. The inner face of the cancellation insertion inlet 17 at the opening upper edge 20 and the upper face of the terminal storage space 14 are continuously flush at the same height.

<The Short Terminal 22>

Each terminal storage space 14 stores a short terminal 22 therein. The short terminal 22 is a single piece that includes a base 23 to fix the short terminal 22 while being positioned in the terminal storage space 14 and left and right elastic contact pieces 24 provided at the upper side of the base 23. The elastic contact pieces 24 can be deformed elastically in the up-and-down direction. The contact pieces 24 elastically contact the lower face of the square tube section 13 of the female terminal fittings 12 at the upper side thereof to short circuit these female terminal fittings 12.

<Second Housing 30>

Figure 3:
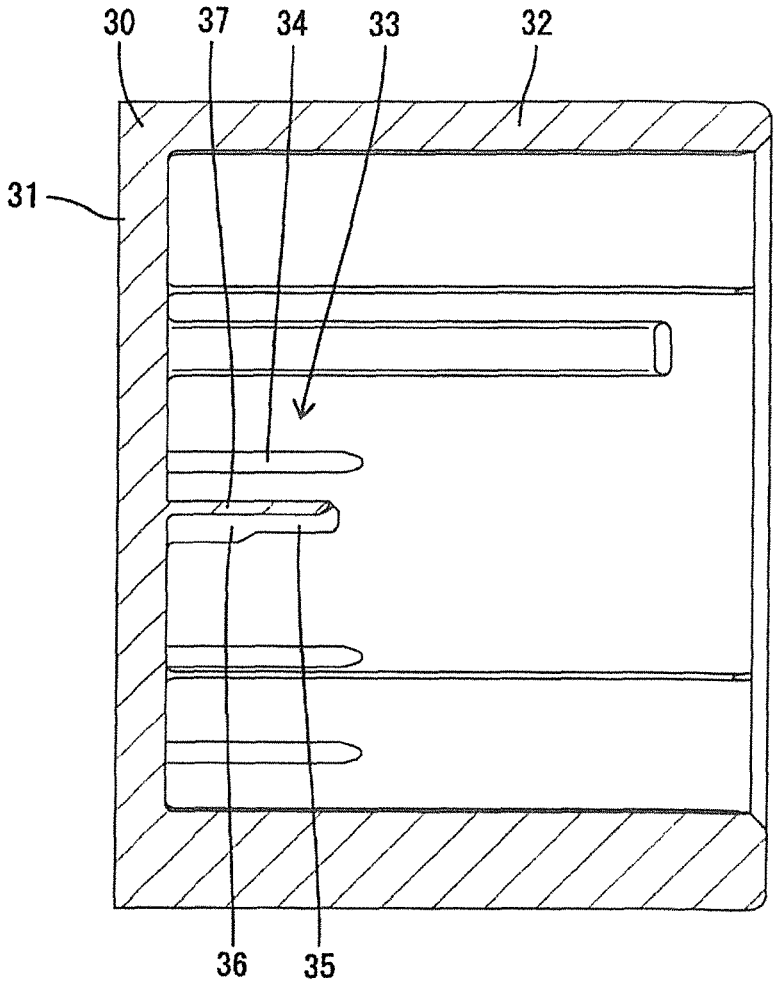
FIG. 3 is a side cross-sectional view of the second housing illustrating the short-cancelling projection that is not deformed.

The second housing 30 is made of synthetic resin and includes, as shown in FIG. 3, a terminal retention portion 31 and a square-tubular hood 32 protruding from the outer periphery of the terminal retention portion 31 to the front. Tabs 34 at the ends of the male terminal fittings 33 attached to the terminal retention portion 31 are in the hood 32. Short-cancelling projections 35 corresponding to the respective cancellation insertion inlets 17 of the first housing 10 also are in the hood 32. Each short-cancelling projection 35 is cantilevered from the front end face of the terminal retention portion 31 to the front and is integrated with the terminal retention portion 31. The short-cancelling projection 35 protrudes in a direction along which the second housing 30 is mated with the first housing 10.

<Short-cancelling Projection 35>

Figure 5:
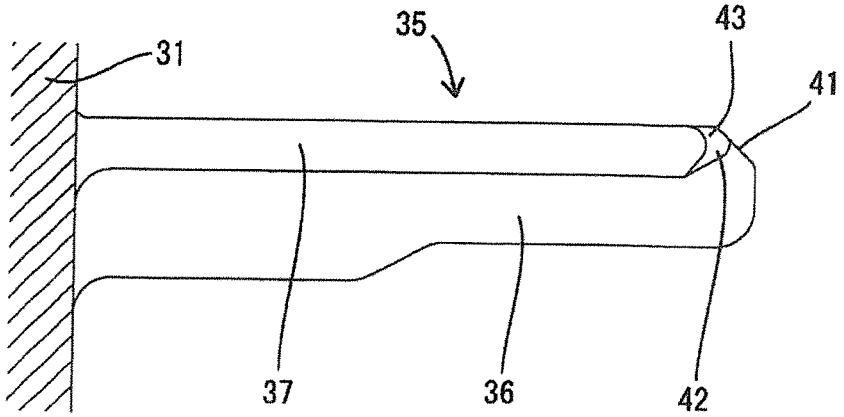
FIG. 5 is a partially-enlarged cross-sectional view illustrating the short-cancelling projection that is not deformed.
Figure 6:
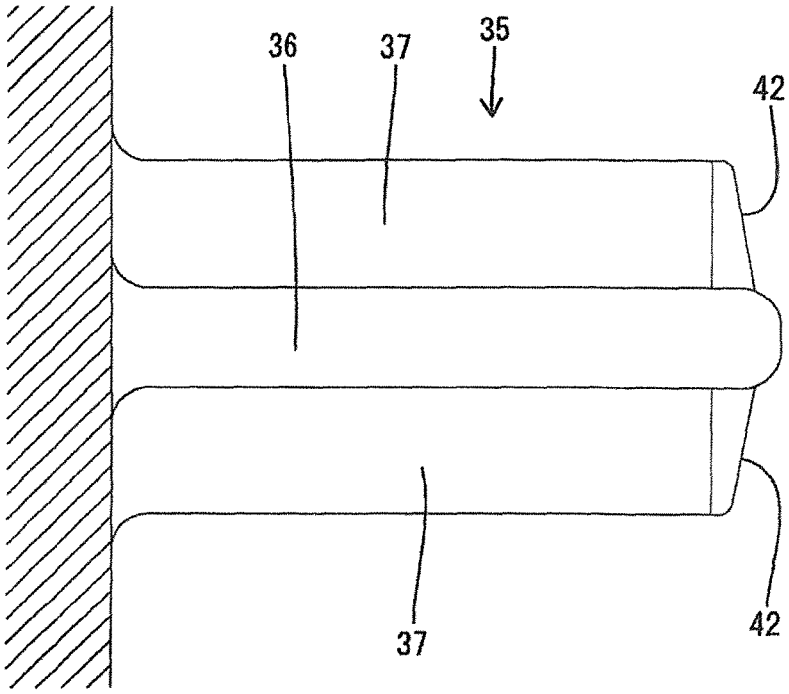
FIG. 6 is a partially-enlarged bottom view illustrating the short-cancelling projection that is not deformed.
Figure 7:
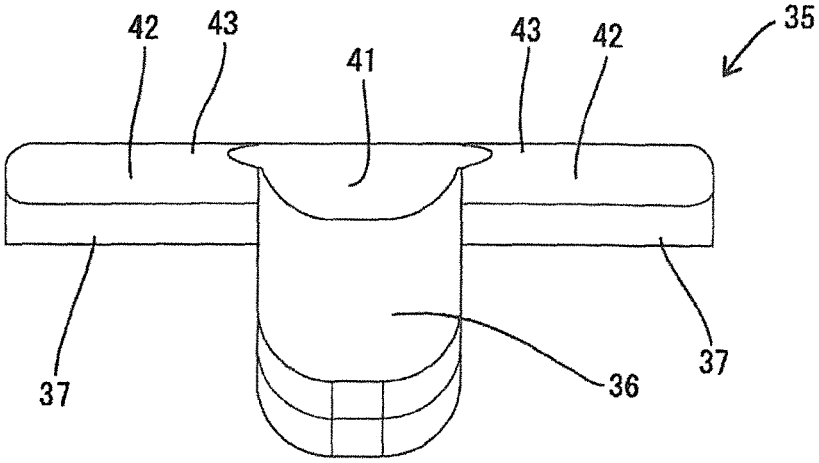
FIG. 7 is a partially-enlarged front view illustrating the short-cancelling projection that is not deformed.

As shown in FIGS. 5 to 7, the short-cancelling projection 35 includes a support 36 and two plate-shaped insulating portions 37 that are symmetric in the left-and-right direction. The support 36 has an elongated shape extending in the front-and-rear direction. When seen from a direct light viewing angle, the support 36 has a substantially-square shape as shown in FIG. 7 for which the height is slightly larger than the width. A region of the support 36 except for the front end section (tip end) has an upper face that forms a horizontal surface parallel to the direction along which the housings 10 and 30 are mated. The lower face of the support 36 has a substantially arc shape when seen from a direct light viewing angle. Both of the left and right side faces of the support 36 are a plane parallel to the direction along which both of the housings 10 and 30 are mated.

Two plate-shaped insulating portions 37 have a plate-like shape cantilevered from the upper end of the support 36 to both sides in the left-and-right direction in a horizontal. Specifically, a region at the lower end of the support 36 has a rib-like shape that protrudes from the lower faces of both of the plate-shaped insulating portions 37. This rib-like protrusion of the support 36 functions to improve the bending rigidity of the plate-shaped insulating portion 37 in the up-and-down direction (the plate thickness direction of the plate-shaped insulating portion 37). The plate-shaped insulating portion 37 is formed in a region in the front-and-rear direction that extends from the front face of the terminal retention portion 31 to a position at a slightly-rear side of the front end of the support 36. A major part of the upper face of the plate-shaped insulating portion 37 except that the front end edge has a horizontal surface that is continuously flush to the upper face of the support 36.

<Description of the Function of the Short-cancelling Projection 35>

The connector of this embodiment is used for an airbag circuit for an automobile. Thus, when the first housing 10 and the second housing 30 are separated (or in a not-mated state), the elastic contact pieces 24 are abutted elastically to the lower face of the square tube section 13 of the female terminal fittings 12 to allow the short terminal 22 to retain the female terminal fittings 12 in a short-circuit state. This consequently prevents the airbag from erroneously inflating. When the housings 10 and 30 are mated, the short circuiting of the female terminal fittings 12 is cancelled so that the airbag is operable.

When the short circuiting is cancelled, the short-cancelling projection 35 enters the terminal storage space 14 from the cancellation insertion inlet 17. Then, the plate-shaped insulating portions 37 pass the first opening 18 and the support 36 passes the second opening 19. Then, as shown in FIG. 13, the support 36 is placed between the elastic contact pieces 24 so as to partition the elastic contact pieces 24. The support 36 corresponds to a partition wall 25 that partitions the terminal storage rooms 11 provided in the left-and-right direction and is provided in vicinity below the lower side of this partition wall 25.

Figure 9:
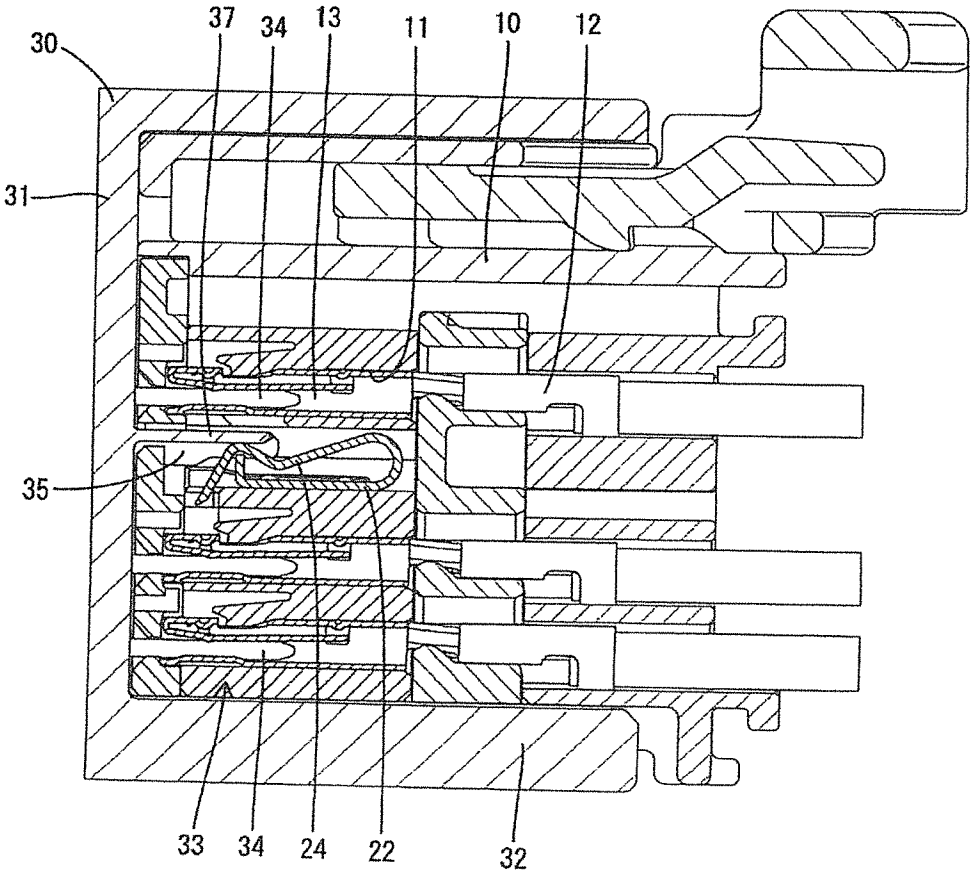
FIG. 9 is a side cross-sectional view illustrating how the first housing is mated with the second housing when the short-cancelling projection is not deformed.

As shown in FIGS. 9 and 13, the plate-shaped insulating portions 37 are abutted to the elastic contact pieces 24 to separate the elastic contact pieces 24 from the female terminal fitting 12, thereby cancelling the short circuiting of the female terminal fittings 12. In this short-cancelling state, the plate-shaped insulating portion 37 is placed between the elastic contact pieces 24 and the female terminal fitting 12, while there is a gap between the upper face of the plate-shaped insulating portion 37 and the lower face of the female terminal fitting 12. This gap is provided for preventing the plate-shaped insulating portion 37 from interfering with the terminal fitting in a process of mating the housings 10 and 30. This gap is obtained by setting the height of the upper face of the plate-shaped insulating portion 37 to be lower than the height of the lower face of the female terminal fitting 12.

Figure 4:
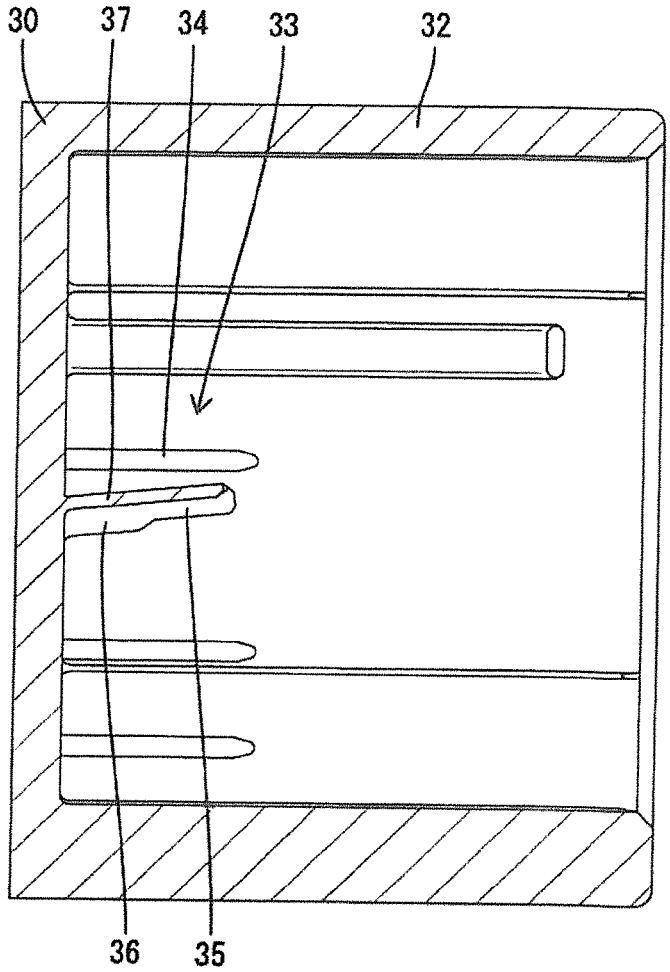
FIG. 4 is a side cross-sectional view of the second housing illustrating the short-cancelling projection that is deformed upwardly.

However, the plate-shaped insulating portion 37 always receives an elastic depression force (biasing force) upward (in the plate thickness direction of plate-shaped insulating portion 37) caused by the elastic restoring force exerted by the elastic contact piece 24 from below. This causes a risk where, when the housings 10 and 30 are mated for a long time, the synthetic resin-made short-cancelling projection 35 may be deformed to bow up and to move into the above gap due to a creep phenomenon. This deformation causes, as shown in FIG. 4, the entire short-cancelling projection 35 to be raised up while the rear end (an end supported by the front face of the terminal retention portion 31) acts as a pivot point. The short-cancelling projection 35 is displaced up in the maximum amount at the front end section of the short-cancelling projection 35 (or a tip end in the protrusion direction).

Figure 14:
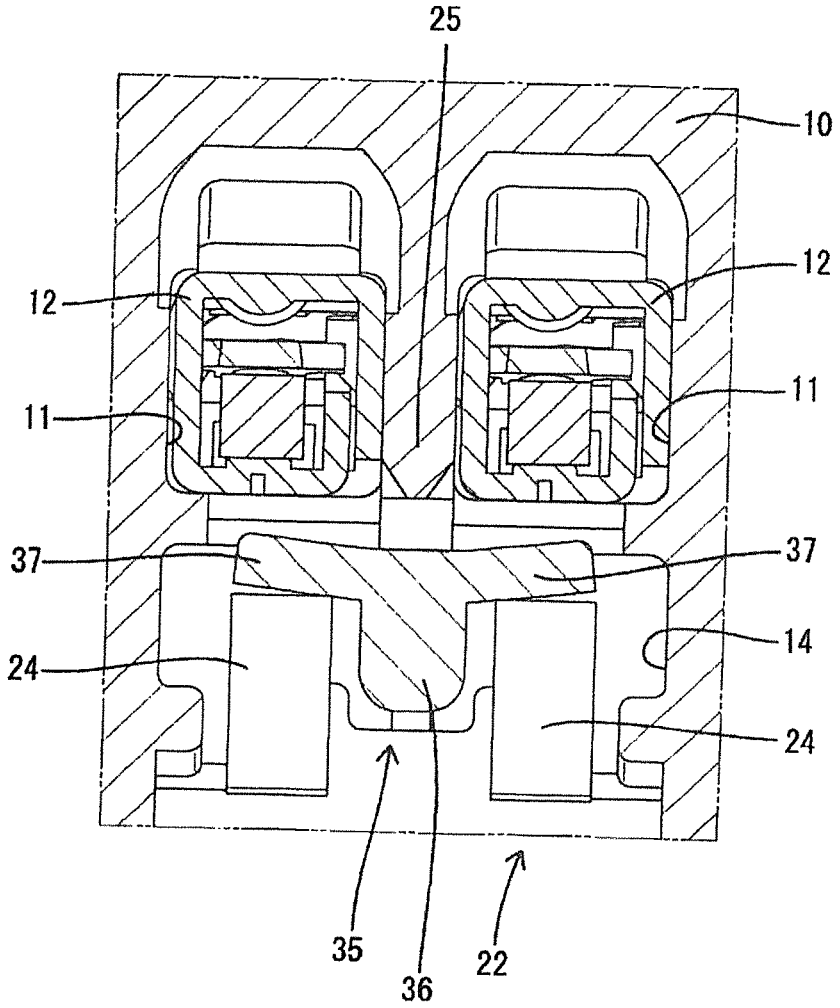
FIG. 14 is a front sectional view illustrating the deformed short-cancelling projection abutted to the elastic contact piece.

At the same time, as shown in FIGS. 8 and 14, the plate-shaped insulating portion 37 is raised up while a base end continuous from the support 36 acts as a pivot point. Then, the plate-shaped insulating portion 37 is displaced up in the maximum amount at the outer edge of the free end side of the plate-shaped insulating portion 37 in the left-and-right direction (an opposite side of the support portion 36). The abnormal deformation as described above is maintained even when the housings 10 and 30 are separated for maintenance for example. Thus, when the housings 10 and 30 are tried to be mated again after the maintenance for example, the short-cancelling projection 35 abuts the front face of the first housing 10. The short-cancelling projection 35 abutted to the front face of the first housing 10 prevents the housings 10 and 30 from being mated.

<First to Third Correction Portions 41, 42, and 43>

To solve this, the short-cancelling projection 35 has the first to third correction portions 41, 42, and 43 as shown in FIGS. 5 and 6 to correct the deformation of the short-cancelling projection 35 and to provide the entry to the cancellation insertion inlet 17. The first correction portion 41 (the first correction portion in claims) is formed at the front end section of the upper face of the support 36 (a tip end in the protrusion direction). The first correction portion 41 is inclined to lower the height while extending toward the tip end of the protrusion of the short-cancelling projection 35. Specifically, a pitch of this first correction portion 41 is an angle configured to, in the up-and-down direction (a direction substantially parallel to the direction along which the elastic contact piece 24 depresses the female terminal fitting 12), approach the short terminal 22 while extending toward the tip end of the protrusion of the short-cancelling projection 35. A region in the protrusion direction of the short-cancelling projection 35 in which the first correction portion 41 is formed extends from the front tip end (protrusion end) of the support 36 to a position at a slightly rear side of the front end of the plate-shaped insulating portion 37.

The second correction portion 42 is formed at the front end edge of the plate-shaped insulating portions 37. The second correction portion 42 continues over the entire width in the left-and-right direction of the plate-shaped insulating portion 37. As shown in FIG. 6, the second correction portion 42 is inclined back in the protrusion direction of the short-cancelling projection 35 while extending away from the support 36. Thus, among parts of the protruding end of the plate-shaped insulating portion 37, at a base end that is continuous from the support portion 36, the second correction portion 42 has the foremost tip end. The foremost tip end of the second correction portion 42 is slightly rearward of the front end of the support 36 and the front end of the first correction portion 41 and slightly front side of the rear end of the first correction portion 41.

The third correction portion 43 is continuous over the entire width region of the protrusion front end edge of the plate-shaped insulating portions 37 extending in the left-and-right direction. Similar to the first correction portion 41, the third correction portion 43 is inclined to lower the height while extending toward the tip end of the protrusion of the short-cancelling projection 35. The base end of the third correction portion 43 (an end closer to the support 36 in the left-and-right direction) is smoothly continuous to the first correction portion 41. Similar to the second correction portion 42, the third correction portion 43 is continuous over the entire width region of the plate-shaped insulating portion 37. Thus, the foremost tip end of the third correction portion 43 is at a position slightly rearward of the front end of the support 36 and the front end of the first correction portion 41 and slightly forward of the rear end of the first correction portion 41.

<Effect of Embodiment>

Figure 11:
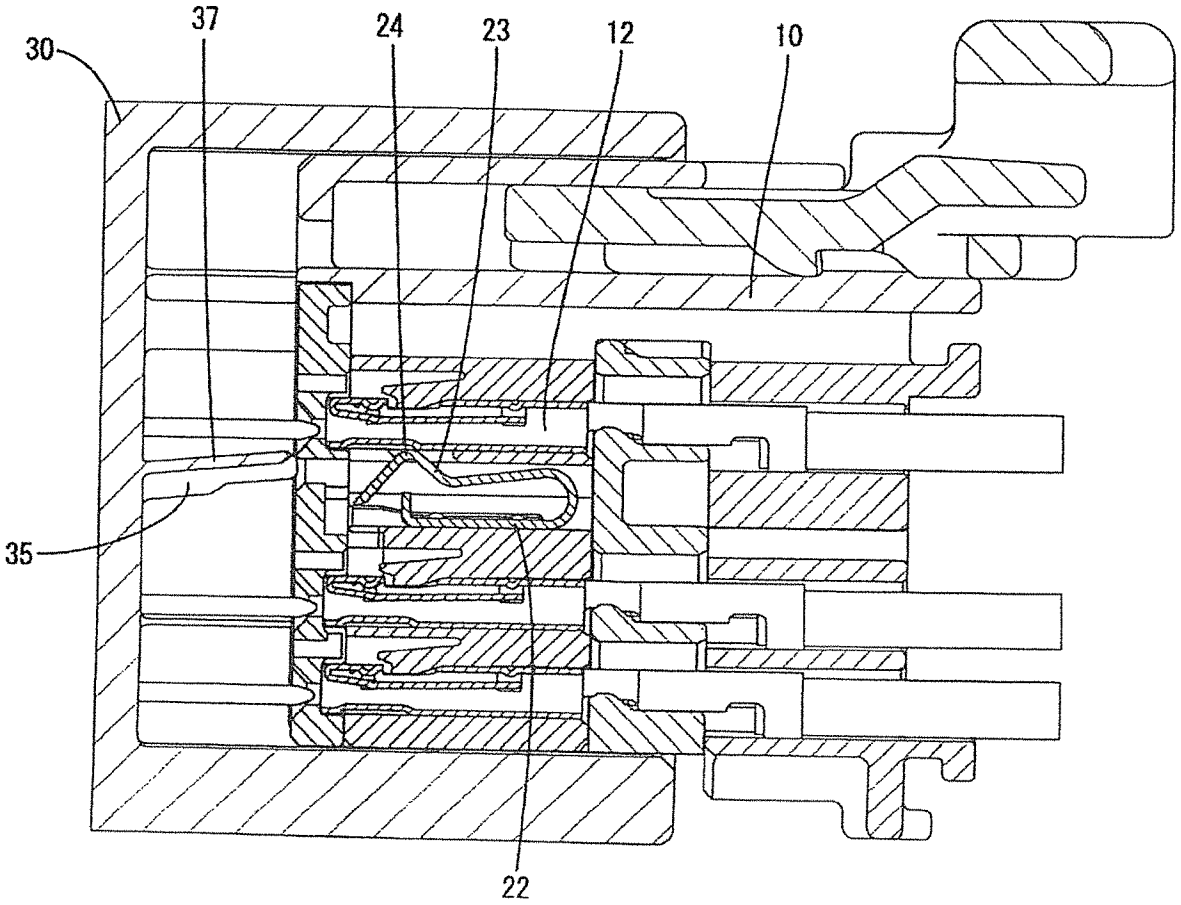
FIG. 11 is a side cross-sectional view illustrating how the deformed short-cancelling projection is corrected in the process of mating the first housing with the second housing.
Figure 12:
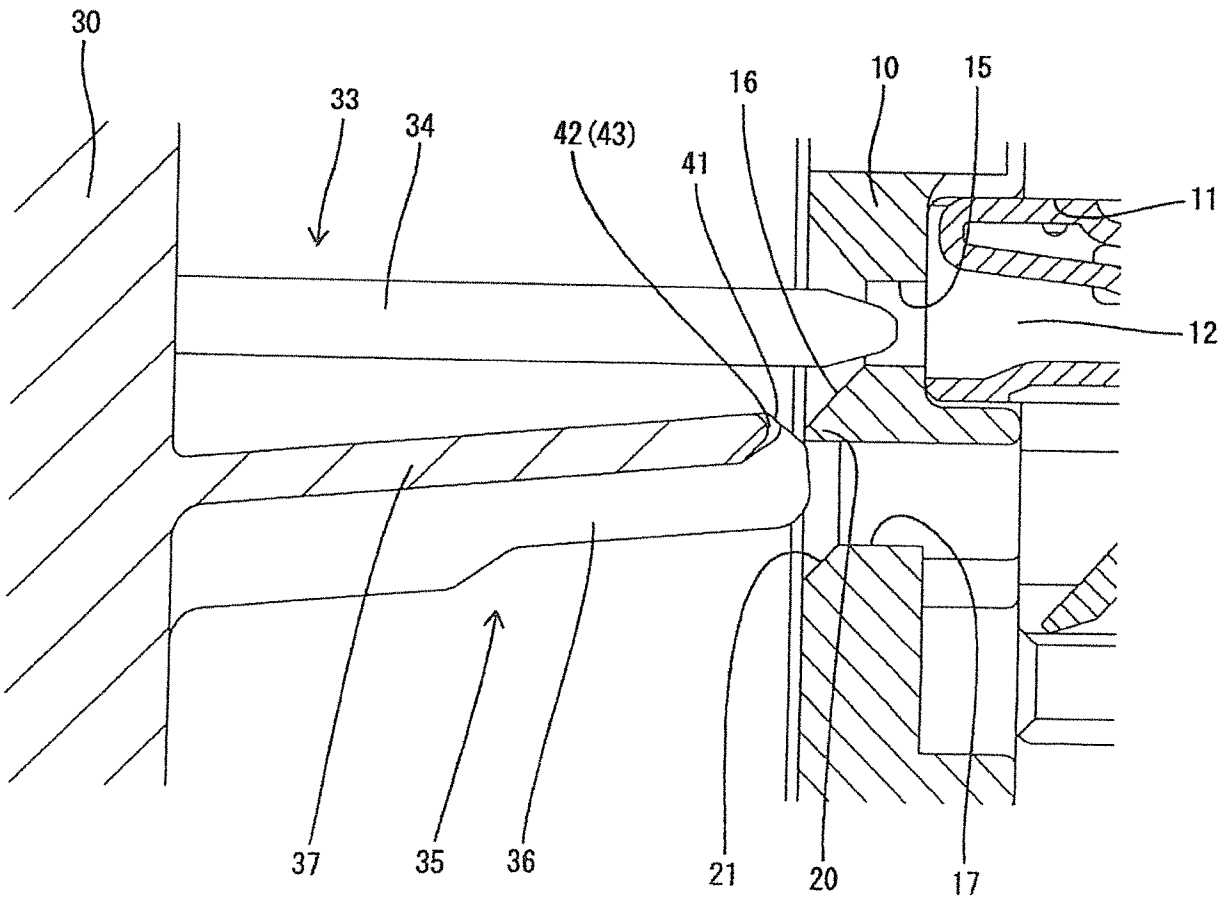
FIG. 12 is a partially-enlarged side cross-sectional view of FIG. 11.

In a process of mating the housings 10 and 30 while the short-cancelling projection 35 is deformed up, as shown in FIGS. 11 and 12, the protrusion end (front end) of the short-cancelling projection 35 has a sliding contact with the opening upper edge 20 of the front face of the first housing 10 in which the guide face 21 is not formed. The front face of the first housing 10 initially abuts only the first correction portion 41 of the support 36 of the short-cancelling projection 35. The first correction portion 41 is inclined down with respect to the direction along which the housings 10 and 30 are mated. This downward inclination of the first correction portion 41 corrects the entire posture of the short-cancelling projection 35 when the housings 10 and 30 are mated further.

After the rear end of the first correction portion 41 reaches the opening upper edge 20, the entire support 36 is inserted into the first opening 18. Thus, a base end of the second correction portion 42 and the third correction portion 43 that is closer to the support 36 subsequently has a sliding contact with the opening upper edge 20. As described above, the plate-shaped insulating portion 37 is deformed up so that the free end side has the maximum displacement amount. The second correction portion 42 is inclined so that the free end is retracted. Thus, the second correction portion 42 and the third correction portion 43 have a sliding contact with the opening upper edge 20 (the first housing 10) at a position that gradually moves to the free end with the increase of the mating of the housings 10 and 30. Then, this displacement of the sliding contact position causes the gradual depression of the plate-shaped insulating portion 37 downward, thus allowing the plate-shaped insulating portion 37 to enter the cancellation insertion inlet 17. This consequently allows both of the housings 10 and 30 to be mated normally.

Figure 10:
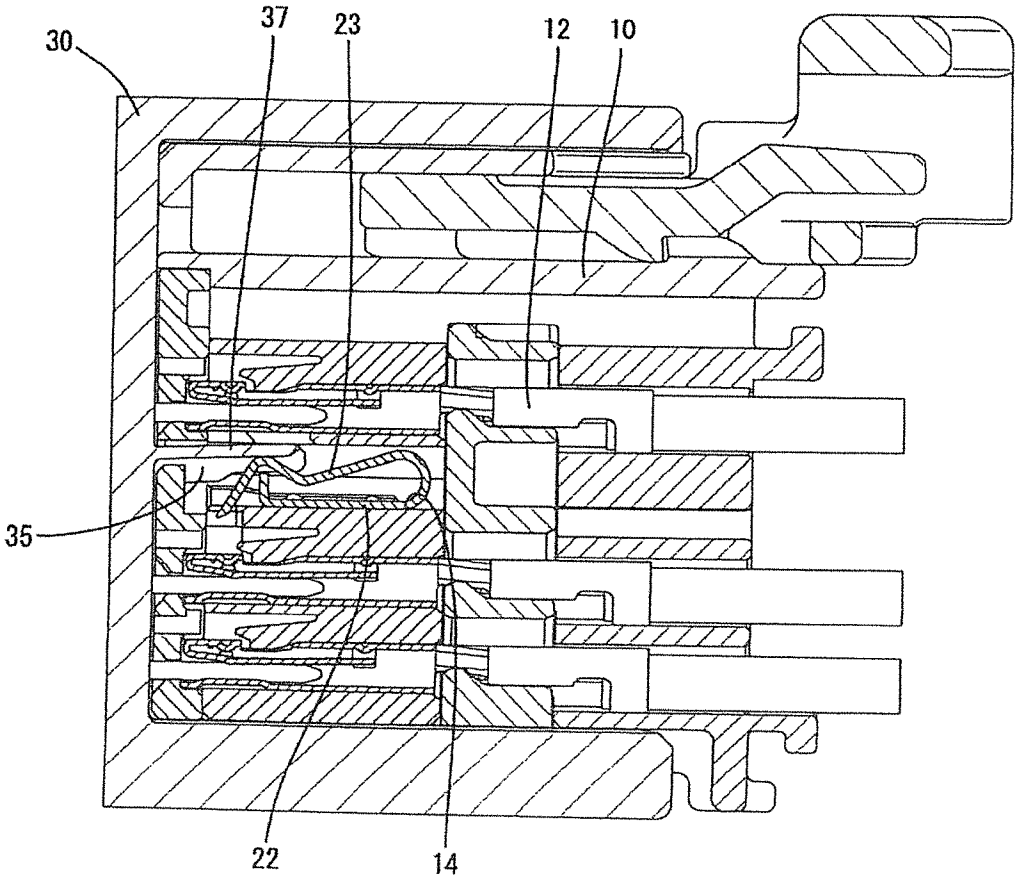
FIG. 10 is a side cross-sectional view illustrating how the first housing is mated with the second housing when the short-cancelling projection is deformed.

The housings 10 and 30 are mated with the short-cancelling projection 35 being deformed, as shown in FIG. 10. Thus, the short-cancelling projection 35 is placed between the elastic contact piece 24 and the female terminal fitting 12 while being deformed up. In this case, the short-cancelling projection 35 is deformed in an amount smaller than that when both of the housings 10 and 30 are separated. Even when the short-cancelling projection 35 is deformed, the elastic contact piece 24 is depressed down by the plate-shaped insulating portion 37 and is separated from the female terminal fitting 12, thus maintaining the female terminal fittings 12 in a short-cancelling state.

<Configuration and Effect of Embodiment>

The connector of this embodiment includes the first housing 10 in which the female terminal fittings 12 are stored laterally, the second housing 30 that can be mated with and separated from the first housing 10, and the short terminal 22 provided in the first housing 10. The short terminal 22 is configured to bring the elastic contact pieces 24 elastically into contact with the female terminal fittings 12 when the housings 10 and 30 are separated to thereby cause the female terminal fittings 12 to be short-circuited. The second housing 30 has the short-cancelling projection 35 protruding in the same direction as the direction along which the second housing 30 is mated with the first housing 10.

The support 36 the short-cancelling projection 35 is provided to partition the elastic contact pieces 24 while both of the housings 10 and 30 are mated. The plate-shaped insulating portions 37, which similarly constitute the short-cancelling projection 35 as in the support 36, protrudes from the support 36 in directions opposite to each other in the left-and-right direction. The plate-shaped insulating portions 37 are placed between the elastic contact pieces 24 and the female terminal fittings 12 while the housings 10 and 30 are being mated, thereby cancelling the short circuiting of the female terminal fitting 12.

The protruding end of the support 36 and the protruding end of the plate-shaped insulating portions 37 have the first to third correction portions 41, 42, and 43. These correction portions 41, 42, and 43 are configured, in a process of mating the housings 10 and 30, to abut the front face of the first housing 10 to thereby displace the short-cancelling projection 35 in a direction toward the short terminal 22. When both of the housings 10 and 30 are tried to be mated again while the short-cancelling projection 35 being abnormally deformed up by the depression force from the elastic contact piece 24 and away from the short terminal, the first to third correction portions 41, 42, and 43 abut the first housing 10 to displace the short-cancelling projection 35 toward the short terminal 22. This can consequently prevent the short-cancelling projection 35 from being abutted to the first housing 10, thus allowing both of the housings 10 and 30 to be mated smoothly.

The protruding end of the support 36 has the first correction portion 41 inclined down to approach the short terminal 22 while extending toward the tip end of the protrusion of the short-cancelling projection 35. The support 36 is provided to partition a pair of elastic contact pieces 24, thus allowing the support 36 to have a large size in the direction along which the terminal fitting is depressed by the elastic contact piece 24 (up-and-down direction). This can consequently provide a large range within which the correction by the first correction portion 41 can be performed (i.e., a range within which the first housing 10 has a sliding contact with the opening upper edge 20).

The tip end (front end) of the first correction portion 41 is provided at the tip end (or the front side) of the protruding end of the plate-shaped insulating portion 37. This configuration allows, in a process of mating both of the housings 10 and 30, the first correction portion 41 to correct the inclined shape of the short-cancelling projection 35 prior to the abutment of the plate-shaped insulating portion 37 to the first housing 10.

The plate-shaped insulating portion 37 is displaced by the depression from the elastic contact piece 24 in the plate thickness direction (or in an upward direction) in a displacement amount that increases toward the free end side far from the support 36. In view of this, the protruding end of the pair of plate-shaped insulating portions 37 has the second correction portion 42 that is inclined backward in the protrusion direction of the short-cancelling projection 35 while extending away from the support 36. This inclination allows, in a process of mating the housings 10 and 30, the second correction portion 42 to be preferentially abutted to a region closer to the support portion 36 having a relatively-small displacement amount. This can consequently prevent the plate-shaped insulating portion 37 from being abutted to the first housing 10, thus securing allowing both of the housings 10 and 30 to be mated.

The protruding end of plate-shaped insulating portion 37 has the third correction portion 43 inclined to approach the short terminal 22 while extending toward the tip end of the protrusion of the short-cancelling projection 35. This configuration allows, after the correction of the short-cancelling projection 35 by the first correction portion 41, the third correction portion 43 to correct the short-cancelling projection 35. Furthermore, the third correction portion 43 smoothly continues to the first correction portion 41 and can provide the correction operation by the first correction portion 41 and the correction operation by the third correction portion 43 in a continuous manner without being interfered for example.

The invention is not limited to the embodiments described through the above description and drawings. Embodiments as described below, for example, also are included in the scope of the invention.

In the above embodiment, the correction portion was formed both at the protruding end of the support portion and at the protruding end of the plate-shaped insulating portion. However, the correction portion also may be formed at any protruding end of those of the support portion and the plate-shaped insulating portion. Specifically, only any one or two correction portions of those of the first to third correction portions also may be formed.

In the above embodiment, the support portion has a rib-like shape protruding from the lower face of the plate-shaped insulating portion. However, the support portion also may have a plate-like shape having a substantially-right angle to the plate-shaped insulating portion.

In the above embodiment, the tip end of the first correction portion formed at the protruding end of the support portion is provided at the front side of the tip end of the plate-shaped insulating portion. However, the invention is not limited to this. The tip end of the first correction portion may be provided at the same position as that of the tip end of the protruding end of the plate-shaped insulating portion (the second correction portion) or at the rear side of the tip end of the protruding end of the plate-shaped insulating portion (the second correction portion).

In the above embodiment, the first correction portion and the second correction portion are continued smoothly. However, the first correction portion and the third correction portion also may be continuous in a step-like manner or with an angle or may be separated from each other.

In the above embodiment, the third correction portion is continuously formed over the entire width of the protruding end of the plate-shaped insulating portion. However, the invention is not limited to this. The third correction portion also may be formed only in a region of the protruding end of the plate-shaped insulating portion close to the support portion or may be formed at an end of the protruding end of the plate-shaped insulating portion at the opposite side of the support portion or may be formed only at the center-side region in the width direction of the protruding end of the plate-shaped insulating portion.

10 First housing
12 Female terminal fitting
22 Short terminal
24 Elastic contact piece
30 Second housing
35*q* Short-cancelling projection
36 Support portion
37 Plate-shaped insulating portion
41 First correction portion
42 Second correction portion
43 Third correction portion

The invention claimed is:

1. A connector assembly, comprising:

a first housing configured to store first and second laterally arranged female terminal fittings therein;

a second housing capable of being mated with and separated from the first housing;

a short terminal provided in the first housing, the short terminal having first and second elastic contact pieces that elastically contact the first and second female terminal fittings respectively when the first housing is being separated from the second housing and to thereby cause short circuiting of the first and second female terminal fittings;

a short-cancelling projection formed in the second housing and protruding in a direction along which the second housing is mated with the first housing, the short-cancelling projection including:

a support configured to partition the first and second elastic contact pieces from one another when the first housing is being mated with the second housing, a support correction portion formed on a protruding end of the support, the support correction portion being configured to abut the first housing and being inclined to approach the short terminal while extending toward a tip end in a protruding direction of the short-cancelling projection;

first and second plate-shaped insulating portions protruding laterally from the support in opposite directions from each other, the first and second plate-shaped insulating portions being configured to be placed respectively between the first and second elastic contact pieces and the first and second terminal fittings to cancel the short circuiting of the first and second terminal fittings when the first housing is mated with the second housing, leading ends of the first and second plate-shaped insulating portions in the protruding direction of the short-cancelling projection being inclined to have reduced thicknesses at positions approaching the tip end of the short-cancelling projection to form further correction portions on the plate shaped insulating portions.

2. The connector assembly of claim 1, wherein the tip end of the support correction portion is provided beyond the leading ends of the plate-shaped insulating portions in the protruding direction of the short-cancelling projection.

3. The connector assembly of claim 1, wherein the leading ends of the plate-shaped insulating portions are inclined backward in the protruding direction of the short-cancelling projection while extending away from the support.

4. The connector assembly of claim 1, wherein areas of the leading ends of the first and second plate-shaped insulating portions that are adjacent to the support are smoothly continuous to the support correction portion.

5. A connector assembly, comprising:

a first housing configured to store first and second laterally arranged female terminal fittings therein;

a second housing capable of being mated with and separated from the first housing;

a short terminal provided in the first housing, the short terminal having first and second elastic contact pieces that elastically contact the first and second female terminal fittings respectively when the first housing is being separated from the second housing and to thereby cause short circuiting of the first and second female terminal fittings;

a short-cancelling projection formed in the second housing and protruding in a protruding direction along which the second housing is mated with the first housing, the short-cancelling projection including:

a support configured to partition the first and second elastic contact pieces from one another when the first housing is being mated with the second housing;

first and second plate-shaped insulating portions protruding laterally from the support in opposite directions from each other, the first and second plate-shaped insulating portions being configured to be placed respectively between the first and second elastic contact pieces and the first and second terminal fittings to cancel the short circuiting of the first and second terminal fittings when the first housing is mated with the second housing, leading ends of the plate-shaped insulating portions in the protruding direction of the short-cancelling projection being inclined to be farther backward from a protruding end of the short-cancelling projection at greater lateral distances from the support, the leading ends of the plate-shaped insulating portions being abutted to the elastic contact pieces to separate the elastic contact pieces from the female terminal fitting when the first housing is mated with the second housing; and a correction portion formed on at least one of a protruding end of the support and protruding ends of the plate-shaped insulating portions, the correction portion being configured to abut the first housing and to displace the short-cancelling projection in a direction along which the short-cancelling projection approaches the short terminal.

6. The connector assembly of claim 5, wherein a tip end of the correction portion is on the support and is disposed at a position beyond the leading ends of the plate-shaped insulating portions in the protruding direction of the short-cancelling projection.

7. The connector assembly of claim 6, wherein areas of the leading ends of the first and second plate-shaped insulating portions that are adjacent to the support are smoothly continuous to the correction portion.

* * * * *